US010763617B2

(12) United States Patent
Shimba et al.

(10) Patent No.: US 10,763,617 B2
(45) Date of Patent: Sep. 1, 2020

(54) MOVABLE CONNECTOR

(71) Applicant: IRISO ELECTRONICS CO., LTD., Yokohama, Kanagawa (JP)

(72) Inventors: Daichi Shimba, Kanagawa (JP); Mayu Nishizawa, Kanagawa (JP)

(73) Assignee: IRISO ELECTRONICS CO., LTD., Kanagawa (JP)

( * ) Notice: Subject to any disclaimer, the term of this patent is extended or adjusted under 35 U.S.C. 154(b) by 0 days.

(21) Appl. No.: 16/600,053

(22) Filed: Oct. 11, 2019

(65) Prior Publication Data

US 2020/0127417 A1 Apr. 23, 2020

(30) Foreign Application Priority Data

Oct. 19, 2018 (JP) ..... 2018-197840

(51) Int. Cl.

| | |
|---|---|
| ***H01R 13/64*** | (2006.01) |
| ***H01R 13/631*** | (2006.01) |
| ***H01R 13/502*** | (2006.01) |
| *H01R 12/71* | (2011.01) |
| *H01R 107/00* | (2006.01) |
| *H01R 24/60* | (2011.01) |

(52) U.S. Cl.

CPC ..... *H01R 13/6315* (2013.01); *H01R 13/5025* (2013.01); *H01R 12/716* (2013.01); *H01R 24/60* (2013.01); *H01R 2107/00* (2013.01)

(58) Field of Classification Search

CPC ..... H01R 13/28

USPC ..... 439/248, 247

See application file for complete search history.

(56) References Cited

U.S. PATENT DOCUMENTS 7,121,888 B2 * 10/2006 Brandt ..... H01R 13/512 439/607.05

7,300,295 B2 * 11/2007 Kimura ..... H01R 12/7005 439/159

7,458,837 B2 * 12/2008 Mineo ..... G01R 1/0416 324/756.05

FOREIGN PATENT DOCUMENTS

JP 2013016363 A 1/2013

* cited by examiner

*Primary Examiner* — Phuong K Dinh

(74) *Attorney, Agent, or Firm* — Cermak Nakajima & McGowan LLP; Tomoko Nakajima

(57) ABSTRACT

Occurrence of contact point slide due to vibration is suppressed in a movable connector that has a floating function from a technical approach that is different from the related art. A movable connector includes a displacement support member that includes a flexible support portion that is elastically deformable in a fitting direction, in which a mating connector is to be fitted with a movable housing, with the flexible support portion abutting against the movable housing. The movable housing includes a bottom wall, against which the mating connector abuts in the fitting direction. The movable housing is displaced in the fitting direction with the flexible support portion elastically deformed in the fitting direction when the mating connector presses the bottom wall in the fitting direction.

7 Claims, 12 Drawing Sheets

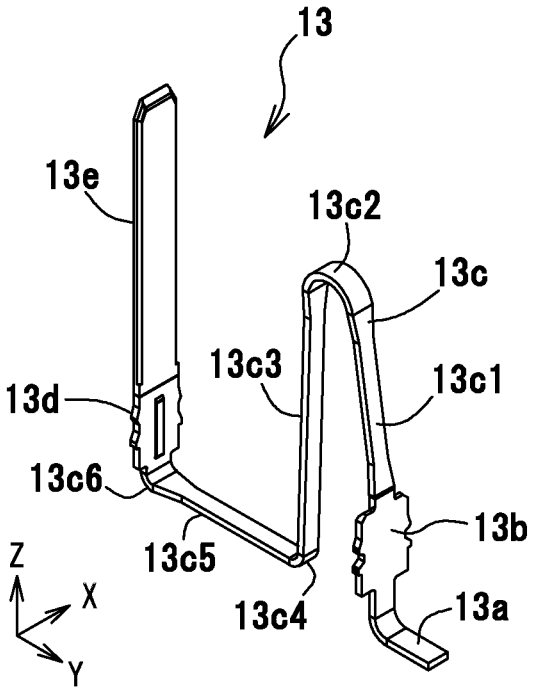
Fig.5A
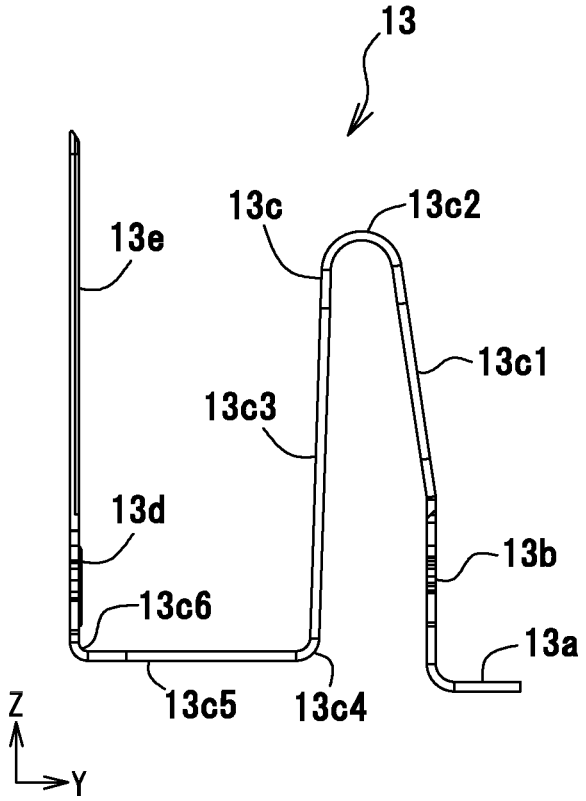
Fig.5B
Fig.6
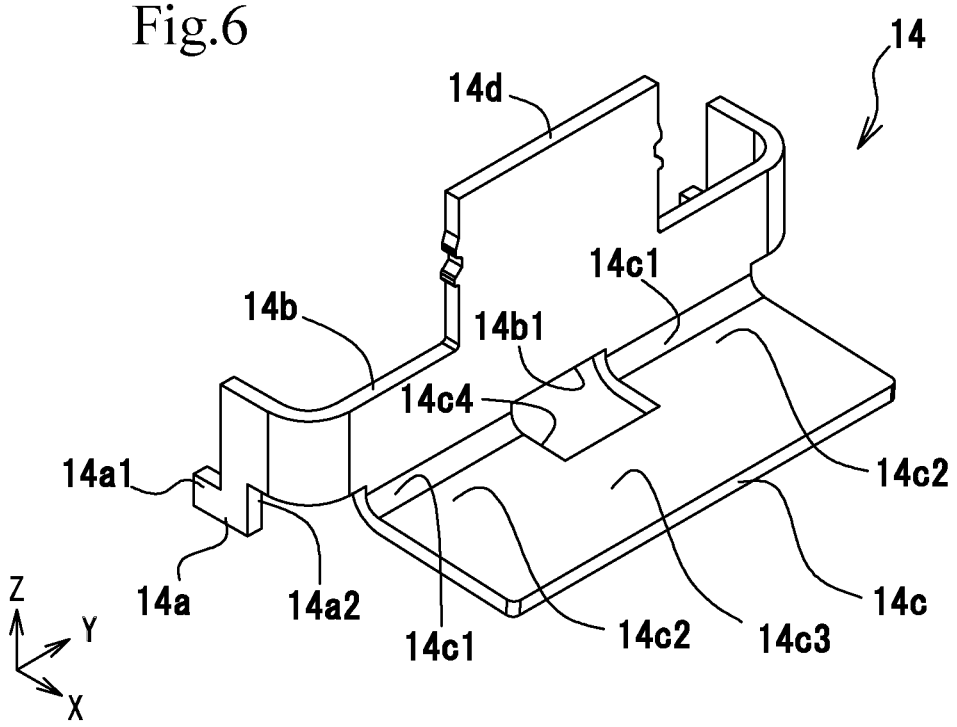

MOVABLE CONNECTOR

BACKGROUND OF THE INVENTION

1. Field of the Invention

The present invention relates to a movable connector that has a floating function and a connection structure for the movable connector.

2. Description of the Related Art

Movable connectors are known as connectors that establish conductive connection between a circuit on a substrate and a connection object. A movable connector includes a fixed housing to be installed on the substrate, a movable housing to be fitted with the connection object, and a terminal that supports the fixed housing and the movable housing so as to be relatively displaceable. The terminal is formed as a conductive metal piece. The terminal includes a substrate connection portion to be connected to the substrate, a contact portion disposed on the movable housing to make conductive contact with the connection object, and a movable portion that supports the movable housing so as to be displaceable with respect to the fixed housing. The movable portion is formed as an elastically deformable spring piece. An example of the movable connector is disclosed in Japanese Unexamined Patent Application Publication No. 2013-16363 (FIG. 3), for example.

SUMMARY OF THE INVENTION

The movable connector discussed earlier is occasionally subjected to vibration in a fitted state in which the movable connector is fitted with the connection object. The vibration is transmitted to the movable connector through the substrate, on which the movable connector is installed, because the substrate is deflected. Alternatively, the vibration is transmitted to the movable connector from the connection object. Specifically, in the case where the connection object is a mating connector, the vibration is transmitted to the movable connector through a mating substrate, on which the mating connector is installed, and the mating connector because the mating substrate is deflected. When the vibration is transmitted to the movable connector, "contact point slide", in which the contact portion of the terminal slides finely with respect to the connection object, is occasionally caused. The contact point slide tends to be caused in the case where the vibration is transmitted to the movable connector along a fitting direction, in which the connection object is fitted with the movable connector, and an extraction direction which is opposite to the fitting direction. When the contact point slide is repeated, plating at a contact point portion of the terminal and plating at a portion of contact with a contact point portion of the connection object are peeled to increase a resistance value. As a result, good conductive connection may be impaired.

The present invention has been made in view of the related art described above as the background. That is, it is an object of the present invention to suppress occurrence of contact point slide due to vibration in a movable connector that has a floating function from a technical approach that is different from the related art.

In order to achieve the foregoing object, the present invention is configured to be characterized as follows.

That is, an aspect of the present invention provides a movable connector including: a first housing to be fixed to a first substrate; a second housing to be fitted with a connection object; and a terminal that includes a movable portion that supports the first housing and the second housing so as to be relatively displaceable and a contact portion that makes conductive contact with the connection object, in which the movable connector further includes a displacement support member that includes a flexible support portion that is elastically deformable in a fitting direction, in which the connection object is to be fitted with the second housing, with the flexible support portion abutting against the second housing, the second housing includes a connection object abutment portion, against which the connection object abuts in the fitting direction, and the second housing is displaced in the fitting direction with the flexible support portion elastically deformed in the fitting direction when the connection object presses the connection object abutment portion in the fitting direction.

In the present invention, when the connection object presses the connection object abutment portion of the second housing, the flexible support portion of the displacement support member is elastically deformed in the fitting direction with the flexible support portion abutting against the second housing. Consequently, the second housing, which is displaceably supported by the movable portion of the terminal, can be displaced in the fitting direction. After that, when pressing of the connection object in the fitting direction is canceled, the second housing is displaced in a direction opposite to the fitting direction with the flexible support portion and the movable portion of the terminal returned to the original state. The movable connector according to the present invention is configured as a "Z-direction movable connector" that is displaceable in the Z direction (fitting direction and a direction (extraction direction) opposite thereto).

When the second housing is displaced in the fitting direction, the second housing is in abutment with the flexible support portion, and is supported by the flexible support portion while receiving a repulsive force of the flexible support portion which is elastically deformed. Therefore, the position of fitting between the second housing and the connection object is not varied even if the second housing is displaced in the fitting direction. Hence, with the movable connector according to the present invention, there is no positional deviation in the position of contact between the contact portion of the terminal and the connection object, and occurrence of contact point slide can be suppressed.

The displacement support member may include a first housing fixed portion fixed to the first housing, and a first substrate fixed portion to be fixed to the first substrate.

With the present invention, the displacement support member can also be used as a fixing member that fixes the first housing to the first substrate, which makes it possible to reduce the number of parts and reduce the area occupied on the first substrate compared to a case where the displacement support member and the fixing member are provided separately. The first substrate fixed portion can be fixed to the first substrate using solder, by way of example.

The displacement support member may include an auxiliary flexible support portion formed of a spring that biases the second housing in an extraction direction for extraction of the connection object, which is opposite to the fitting direction, to maintain the connection object abutment portion and the connection object in abutment with each other.

With the present invention, the connection object abutment portion and the connection object are maintained in abutment with each other with the auxiliary flexible support portion, which is formed of a spring, biasing the second housing in the extraction direction when the connection object is relatively displaced in the extraction direction with respect to the second housing. Therefore, the connection object and the second housing are displaced in the extraction direction without varying the position of fitting therebetween. Thus, occurrence of contact point slide can be suppressed without deviation in the position of contact between the connection object and the contact portion of the terminal, even if the connection object is relatively displaced in the extraction direction with respect to the second housing.

Another aspect of the present invention provides a movable connector including: a first housing to be fixed to a first substrate; a second housing to be fitted with a connection object; and a terminal that includes a movable portion that supports the first housing and the second housing so as to be relatively displaceable and a contact portion that makes conductive contact with the connection object, in which the first housing includes a flexible support portion that is elastically deformable in a fitting direction, in which the connection object is to be fitted with the second housing, with the flexible support portion abutting against the second housing, the second housing includes a connection object abutment portion, against which the connection object abuts in the fitting direction, and the second housing is displaced in the fitting direction with the flexible support portion elastically deformed in the fitting direction when the connection object presses the connection object abutment portion in the fitting direction.

In the present invention, when the connection object presses the connection object abutment portion of the second housing, the flexible support portion of the first housing is elastically deformed in the fitting direction with the flexible support portion abutting against the second housing. Consequently, the second housing, which is displaceably supported by the movable portion of the terminal, can be displaced in the fitting direction. After that, when pressing of the connection object in the fitting direction is canceled, the second housing is displaced in a direction opposite to the fitting direction with the flexible support portion and the movable portion of the terminal returned to the original state. The movable connector according to the present invention is configured as a "Z-direction movable connector" that is displaceable in the Z direction (fitting direction and a direction (extraction direction) opposite thereto).

When the second housing is displaced in the fitting direction, the second housing is in abutment with the flexible support portion, and is supported by the flexible support portion while receiving a repulsive force of the flexible support portion which is elastically deformed. Therefore, the position of fitting between the second housing and the connection object is not varied even if the second housing is displaced in the fitting direction. Hence, with the movable connector according to the present invention, there is no positional deviation in the position of contact between the contact portion of the terminal and the connection object, and occurrence of contact point slide can be suppressed.

In the present invention, in addition, the flexible support portion is formed on the first housing. Thus, the number of parts can be reduced compared to a case where the flexible support portion is constituted as a single part.

The first housing may include a pair of first side walls, and the movable connector may further include a displacement regulation member provided on the first housing so as to cross between the first side walls, the displacement regulation member including a first displacement regulation portion that regulates displacement of the second housing in an extraction direction which is opposite to the fitting direction.

In the present invention, the movable connector includes the displacement regulation member which is separate from the first housing and which includes the first displacement regulation portion which regulates displacement of the second housing. Thus, the first housing can be simplified in structure, and can be manufactured easily.

The displacement regulation member may include a second displacement regulation portion that regulates displacement of the second housing in a direction that intersects the fitting direction.

In the present invention, the displacement regulation member includes the second displacement regulation portion. Thus, it is possible to reduce the number of parts, simplify the connector structure, and reduce the size of the movable connector compared to a case where the second displacement regulation portion is constituted as a separate member.

The first housing may be formed from a bottom wall disposed on the first substrate and the pair of side walls which are formed as vertical walls that extend upward from the bottom wall, and the displacement regulation member may be provided on the first housing so as to cross above the second housing which is disposed inside the first housing.

In the present invention, the first housing is constituted from the bottom wall and the pair of side walls in a vertical wall shape. Therefore, the first housing can be simplified in structure, and can be manufactured easily. The second housing is disposed inside the first housing, and the displacement regulation member is provided on the first housing so as to cross above the second housing, which regulates excessive displacement of the second housing. Therefore, it is not necessary to form the first housing with a portion that regulates displacement of the second housing. Thus, with the present invention, the structure of the first housing can be further simplified.

With the movable connector according to the present invention, occurrence of contact point slide between the contact portion of the terminal and the connection object can be suppressed while the second housing is displaceable in the fitting direction for the connection object, which can achieve stable conductive connection.

BRIEF DESCRIPTION OF THE DRAWINGS

FIG. 5 illustrates the appearance of a terminal of the movable connector in FIG. 1;

FIG. 6 is a perspective view of a displacement support member of the movable connector in FIG. 1;

DESCRIPTION OF THE PREFERRED EMBODIMENTS

Figure 1:
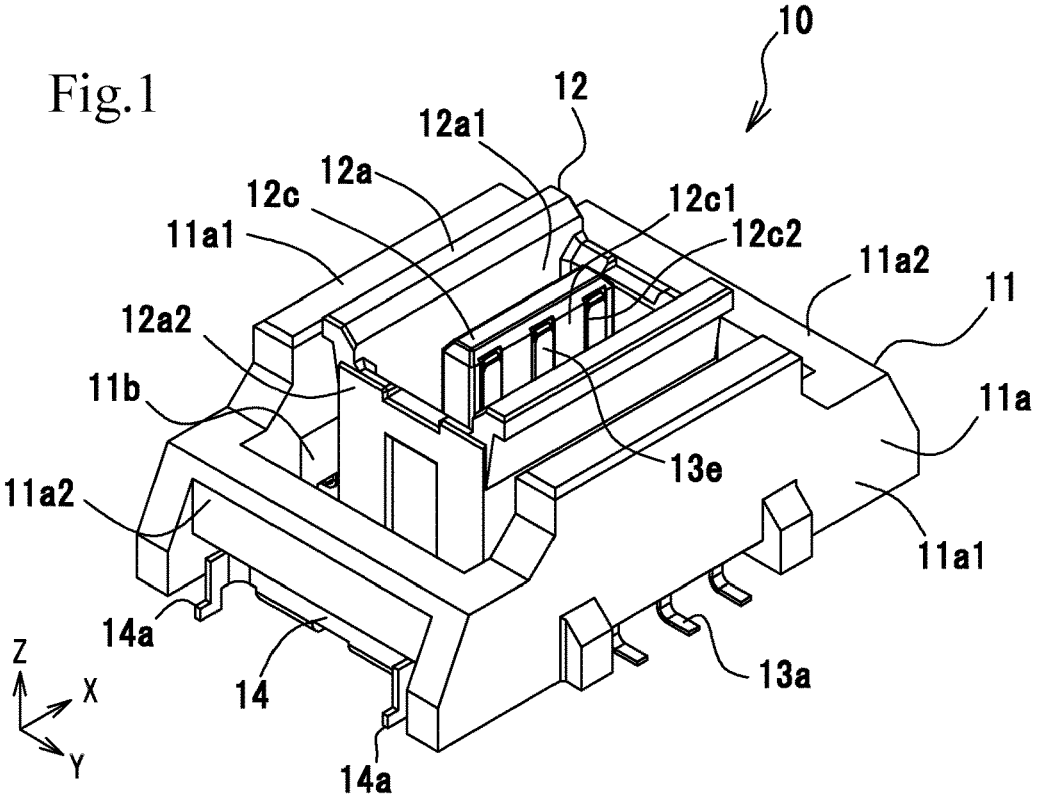
FIG. 1 is a perspective view including a front surface, a left side surface, and an upper surface of a movable connector according to a first embodiment.

An embodiment of the present invention will be described below with reference to the drawings. The following describes a movable connector 10 and a structure for connection between the movable connector 10 and a mating connector 20 which serves as a "connection object". In the specification, claims, and drawings, the longitudinal direction (right-left direction) of the movable connector 10 illustrated in FIG. 1 is defined as the X direction, the depth direction (front-rear direction) of the movable connector 10 is defined as the Y direction, and the height direction (up-down direction) of the movable connector 10 is defined as the Z direction. However, specification of such directions does not limit the mount direction or the use direction of the movable connector 10 according to the present invention unless stated otherwise. In addition, the terms "first" and "second" as used in the specification and claims are used to discriminate different constituent elements of the invention, and are not used to indicate any specific order or order of superiority/inferiority thereof.

First Embodiment [FIGS. 1 to 10]

Configuration of Movable Connector 10 [FIGS. 1 to 6]

The movable connector 10 includes a fixed housing 11 which serves as a "first housing", a movable housing 12 which serves as a "second housing", and a plurality of terminals 13. The movable connector 10 according to the present embodiment further includes a displacement support member 14.

The fixed housing 11 is formed as a resin molded body, and has a peripheral wall 11*a*. A housing portion 11*b* is formed inside the fixed housing 11. The housing portion 11*b* serves as a space that houses the movable housing 12 and that allows displacement of the movable housing 12.

Figure 4:
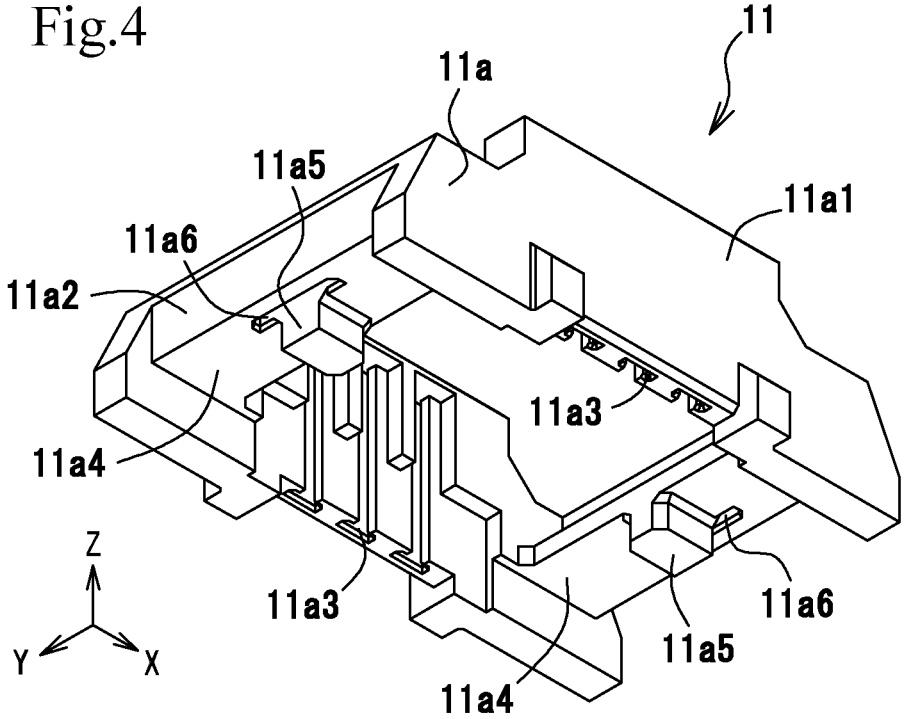
FIG. 4 is a perspective view including a front surface, a left side surface, and a bottom surface of a fixed housing in FIG. 1.

The peripheral wall 11*a* has a pair of first side walls 11*a* l in the shape of vertical walls that extend along the right-left direction X and a pair of second side walls 11*a*2 in the shape of vertical walls that extend along the front-rear direction Y. A plurality of fixed-side terminal holding portions 11*a*3 are arranged in the inner surface of each of the first side walls 11*a* l, and spaced from each other along the right-left direction X. A bottom wall 11*a*4 that projects inward of the peripheral wall 11*a* is formed on each of the second side walls 11*a*2. A displacement regulation protrusion 11*a*5 that projects downward in the height direction Z is formed at the middle portion of each of the bottom walls 11*a*4 in the front-rear direction Y (FIG. 4).

The movable housing 12 is formed as a resin molded body, and has a peripheral wall 12*a*, a bottom wall 12*b* (FIG. 3) which serves as a "connection object abutment portion", and a middle wall 12*c*.

Figure 2:
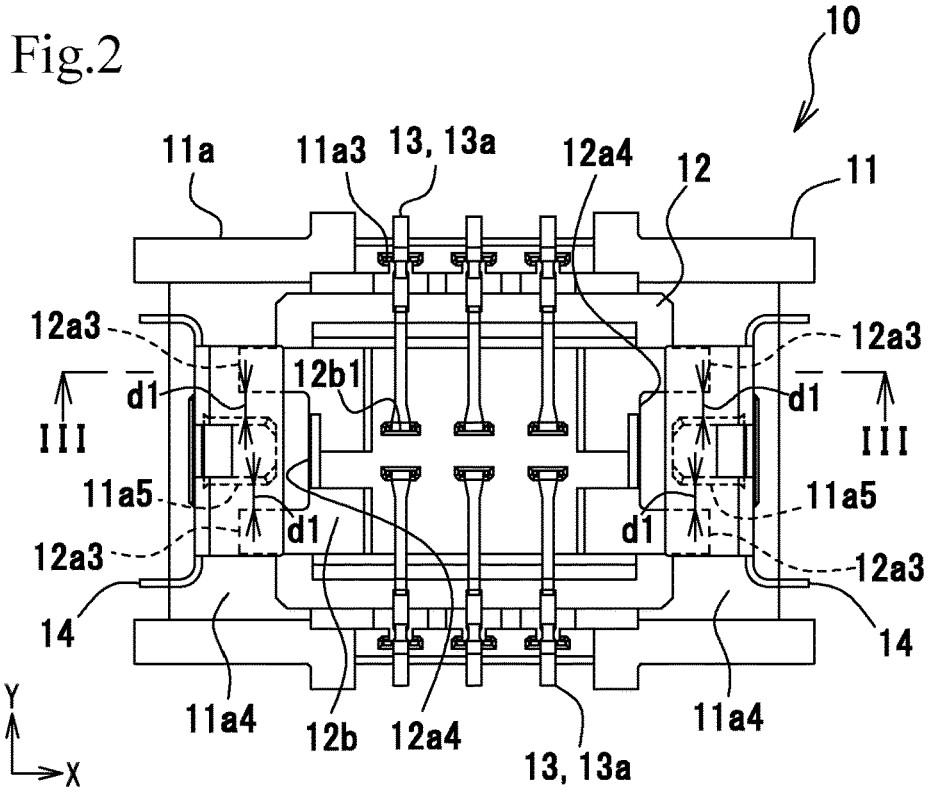
FIG. 2 is a bottom view of the movable connector in FIG. 1.
Figure 3:
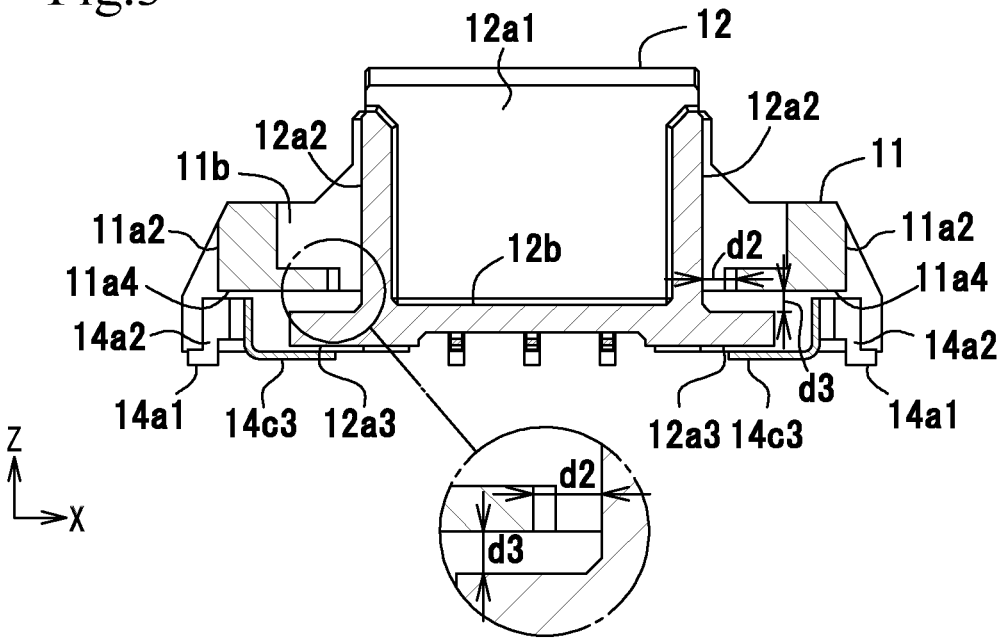
FIG. 3 is a sectional view taken along the line III-III in FIG. 2.

The peripheral wall 12*a* is formed in a rectangular tube shape. A fitting chamber 12*a*1 for fitting connection with the mating connector 20 as the "connection object" is formed inside the peripheral wall 12*a*. A plurality of retention protrusions 12*a*3 are formed on each of right and left side walls 12*a*2 of the peripheral wall 12*a* (FIGS. 2 and 3). The retention protrusions 12*a*3 are formed as "retention portions" in a protruding shape, disposed on the front and rear sides in the front-rear direction Y, and spaced from each other. A recessed portion 12*a*4 is formed between two retention protrusions 12*a*3 (FIG. 2). The displacement regulation protrusion 11*a*5 of the fixed housing 11 is disposed in the recessed portion 12*a*4.

A front-rear movable gap dl is formed between the two retention protrusions 12*a*3 and the displacement regulation protrusion 11*a*5 (FIG. 2). The front-rear movable gap dl enables the movable housing 12 in a stationary state (pre-fitting state and fitting complete state) to be displaced in the front-rear direction Y. The movable housing 12 can be displaced in the front-rear direction Y (forward and rearward) until the retention protrusions 12*a*3 abut against the displacement regulation protrusions 11*a*5. In addition, a right-left movable gap d2 is formed between the side walls 12*a*2 of the movable housing 12 and the bottom walls 11*a*4 of the fixed housing 11 (FIG. 3). The right-left movable gap d2 enables the movable housing 12 in the stationary state (pre-fitting state and fitting complete state) to be displaced in the right-left direction X. The movable housing 12 can be displaced in the right-left direction (rightward and leftward) until the side walls 12*a*2 abut against the bottom walls 11*a*4 of the fixed housing 11. Further, an upper movable gap d3 is formed between the two retention protrusions 12*a*3 and the bottom walls 11*a*4 (FIG. 3). The upper movable gap d3 enables the movable housing 12 in the stationary state (pre-fitting state and fitting complete state) to be displaced upward in the up-down direction Z.

The bottom wall 12*b* which serves as the "connection object abutment portion" is formed between the peripheral wall 12*a* and the middle wall 12*c*. Movable-side terminal holding portions 12*b*1 in a hole shape are formed in the bottom wall 12*b* (FIG. 2). The terminals 13 are press-fitted into the movable-side terminal holding portions 12*b*1 to be fixed.

The middle wall 12*c* projects upward in the height direction Z from the bottom wall 12*b* to form a fitting space (fitting chamber 12*a*1) in a rectangular frame shape in the internal space of the peripheral wall 12*a*. A plurality of terminal holding grooves 12*c*2 are disposed in parallel in the right-left direction X in wall surfaces 12*c*1 of the middle wall 12*c* on the front and rear sides in the front-rear direction Y. The terminal holding grooves 12*c*2 hold contact portions 13*e* of the terminals 13.

As illustrated in FIG. 5, the plurality of terminals 13 are each formed as a bent terminal by stamping a conductive metal piece in a flat plate shape as the material by pressing and bending the metal piece in the plate thickness direction at predetermined locations. The terminals 13 each have a substrate connection portion 13*a*, a fixed housing fixed portion 13*b*, a movable portion 13*c*, a movable housing fixed portion 13*d*, and the contact portion 13*e*.

The substrate connection portion 13*a* is soldered to a substrate circuit on a first substrate P1, which will be discussed later, to be fixed. The fixed housing fixed portion 13*b* is press-fitted into the fixed-side terminal holding portion 11*a*3 to be fixed to the fixed housing 11. The movable housing fixed portion 13*d* is press-fitted into the movable-side terminal holding portion 12*b*1 to be fixed to the movable housing 12. The contact portion 13*e* is formed in a flat plate shape, and inserted from the movable-side terminal holding portion 12*b*1 of the bottom wall 12*b* to be disposed in the terminal holding groove 12*c*2 of the middle wall 12*c*. A plating layer (not illustrated) such as gold plating is formed on the surface of the contact portion 13*e*.

The movable portion 13*c* is formed as a spring piece in a bent shape that is elastically deformable. The movable portion 13*c* includes a first extended portion 13*c*1, a first bent portion 13*c*2, a second extended portion 13*c*3, a second bent portion 13*c*4, a third extended portion 13*c*5, and a third bent portion 13*c*6.

The first extended portion 13*c*1 is formed in a straight shape to extend upward while being inclined in the direction closer toward the movable housing 12 and connect between the upper end of the fixed housing fixed portion 13*b* and the first bent portion 13*c*2. The first bent portion 13*c*2 is formed to be bent in an inverted U-shape and connect between the first extended portion 13*c*1 and the second extended portion 13*c*3. The second extended portion 13*c*3 is formed in a straight shape to extend downward while being inclined in the direction closer toward the movable housing 12 and connect between the first bent portion 13*c*2 and the second bent portion 13*c*4. The second bent portion 13*c*4 is formed to be bent in an L-shape and connect between the second extended portion 13*c*3 and the third extended portion 13*c*5. The third extended portion 13*c*5 is formed in a straight shape to extend horizontally along the bottom wall 12*b* of the movable housing 12 and connect between the second bent portion 13*c*4 and the third bent portion 13*c*6. The third bent portion 13*c*6 is formed to be bent in an L-shape and connect between the third extended portion 13*c*5 and the movable housing fixed portion 13*d*.

The first extended portion 13*c*1, the first bent portion 13*c*2, and the second extended portion 13*c*3 function as a "front-rear direction movable spring" that is elastically deformable in the front-rear direction Y with the first bent portion 13*c*2 serving as a main displacement support point. The "front-rear direction movable spring" absorbs relative positional deviation in the front-rear direction Y between the fixed housing 11 and the movable housing 12, and causes relative displacement in the front-rear direction Y therebetween, through elastic deformation.

In addition, a portion from the first extended portion 13*c*1 to the third extended portion 13*c*5 is elastically deformable while being warped in the right-left direction X to function as a "right-left direction movable spring". The "right-left direction movable spring" absorbs relative positional deviation in the right-left direction X between the fixed housing 11 and the movable housing 12, and causes relative displacement in the right-left direction X therebetween, through elastic deformation.

Further, the second bent portion 13*c*4, the third extended portion 13*c*5, and the third bent portion 13*c*6 function as an "up-down direction movable spring" that is elastically deformable in the Z direction (up-down direction; fitting direction and extraction direction) with the second bent portion 13*c*4 serving as a main displacement support point. The "up-down direction movable spring" absorbs relative positional deviation in the up-down direction Z between the fixed housing 11 and the movable housing 12, and causes relative displacement in the up-down direction Z therebetween, through elastic deformation.

In this manner, the movable portion 13*c* can function as the front-rear direction movable spring, the right-left direction movable spring, and the up-down direction movable spring to absorb positional deviation in the X, Y, and Z directions when fitting connection between the movable connector 10 and the mating connector 20 is established and absorb relative displacement between the movable housing 12 and the mating connector 20, which is caused by external vibration and an external impact received by the movable connector 10 under the use environment, through a combination of displacements in the X, Y, and Z directions.

As illustrated in FIG. 6, the displacement support member 14 is formed as a metal fitting by stamping a metal piece in a flat plate shape as the material by pressing and bending the metal piece in the plate thickness direction at predetermined locations. The displacement support member 14 includes a pair of substrate fixed leg portions 14*a* as a "first substrate fixed portion", a base portion 14*b*, a flexible support portion 14*c*, and a fixed housing fixed portion 14*d* as a "first housing fixed portion". It is not essential that the displacement support member 14 should be constituted from a metal piece, and the displacement support member 14 may be constituted as a resin molded body. In this case, the substrate fixed leg portions 14*a* may be fixed to the first substrate P1 using an adhesive etc.

The substrate fixed leg portions 14*a* are portions to be soldered to the substrate P1 to be fixed, and are used to fix the fixed housing 11 to the first substrate P1. Thus, in general, the displacement support member 14 also functions as a fixing metal fitting used to fix a connector to a substrate. The substrate fixed leg portions 14*a* are provided at both ends of the base portion 14*b*, and each include a distal end portion 14*a*1 that extends in the horizontal direction and a rising portion 14*a*2 that extends upward from the distal end portion 14*a*1. With the rising portions 14*a*2, the base portion 14*b* and the flexible support portion 14*c* are disposed at a floated position above the surface of the substrate P1.

The base portion 14*b* is formed as a band-like piece that extends in the front-rear direction Y.

The flexible support portion 14*c* is formed with a pair of spring piece portions 14*c*2 that extend in the right-left direction X from the lower edge of the base portion 14*b* via bent portions 14*c*1 and a support surface portion 14*c*3 in a flat plate shape to which the respective distal ends of the pair of spring piece portions 14*c*2 are connected. A hole portion 14*c*4 is formed between the pair of spring piece portions 14*c*2. The flexible support portion 14*c* is configured such that the support surface portion 14*c*3 is displaceable in the up-down direction Z with the pair of spring piece portions

14*c*2 deflected in the up-down direction Z with the bent portions 14*c*1 serving as a displacement support point.

Figure 7:
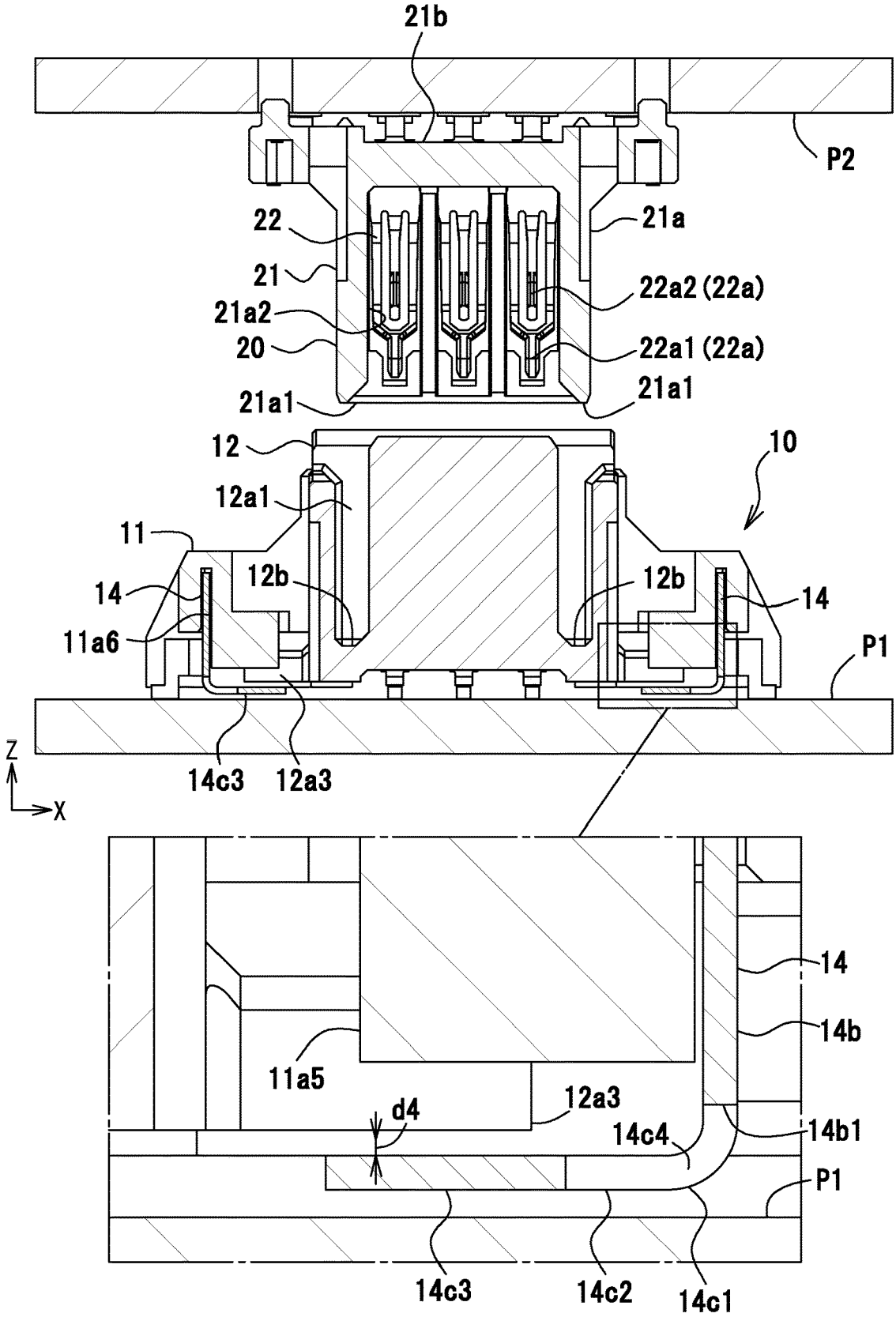
FIG. 7 is a sectional view illustrating the course of establishing fitting connection between the movable connector in FIG. 1 and a mating connector, illustrating a section of the movable connector at the middle in the front-rear direction in a pre-fitting state.
Figure 8:
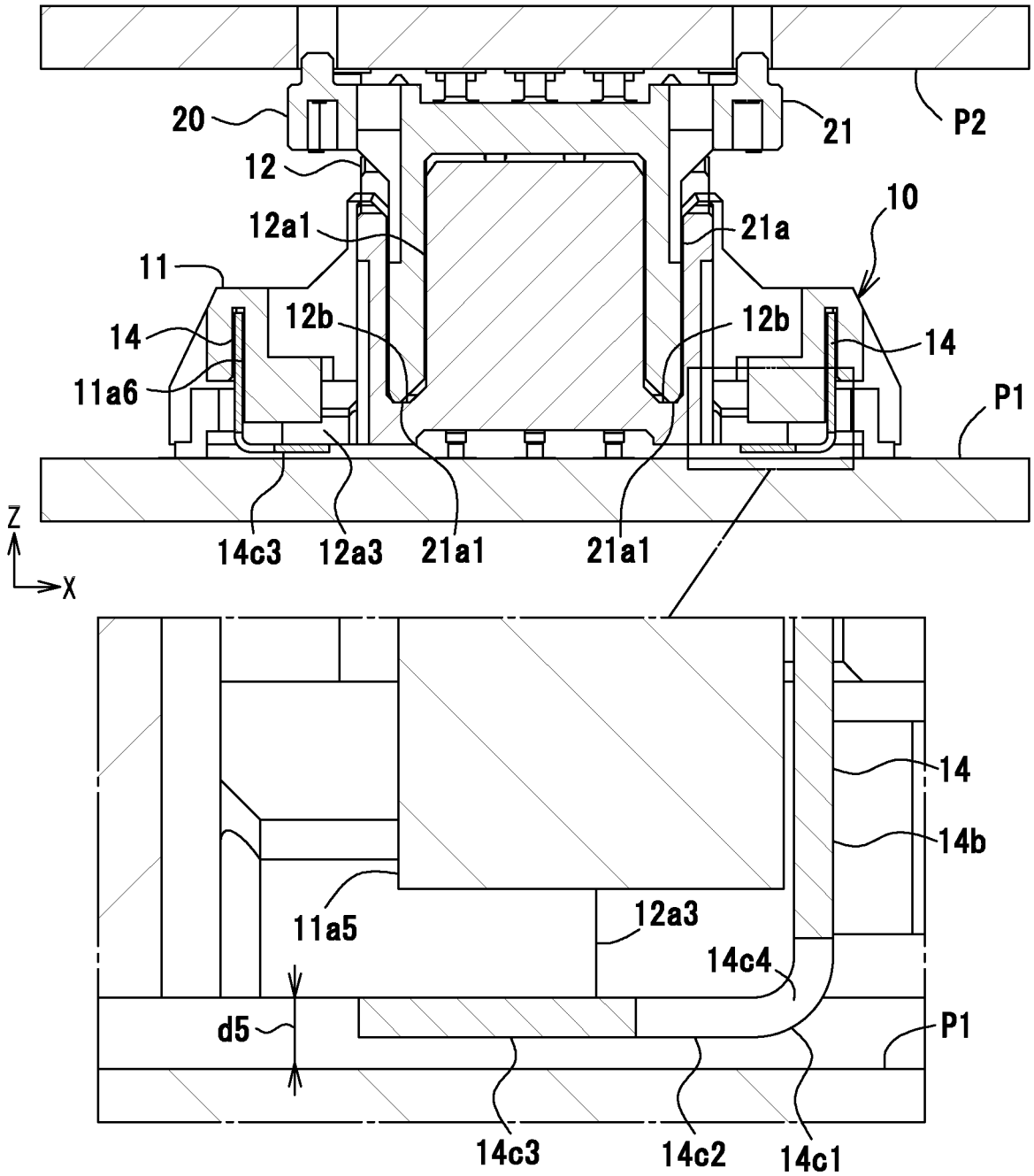
FIG. 8 is a sectional view illustrating a fitting complete state which follows FIG. 7.

A first lower movable gap d4 is formed between the support surface portion 14*c*3 and the two retention protrusions 12*a*3 (FIG. 7). The first lower movable gap d4 enables the movable housing 12 in the pre-fitting state to be displaced downward in the up-down direction Z. In addition, as discussed earlier, with the substrate fixed leg portions 14*a* having the respective rising portions 14*a*2, the support surface portion 14*c*3 is disposed at a position away from the first substrate P1. A second lower movable gap d5 is formed between the first substrate P1 and the bottom surface (retention protrusions 12*a*3) of the movable housing 12 (FIG. 8). The second lower movable gap d5 enables the movable housing 12 and the support surface portion 14*c*3 to be displaced downward in the up-down direction Z. The movable housing 12 is displaceable toward the second lower movable gap d5, and can be actually displaced to the limit of displacement of the support surface portion 14*c*3 or until the support surface portion 14*c*3 abuts against the first substrate P1.

The first lower movable gap d4 is a space that allows the movable housing 12 of the movable connector 10 in the pre-fitting state before being fitted with the mating connector 20 to be displaced toward the first substrate P1. The second lower movable gap d5 is a space that allows the movable housing 12 of the movable connector 10 in the fitting complete state after being fitted with the mating connector 20 to be displaced toward the first substrate P1. The movable connector 10 is structured to have the first lower movable gap d4 and the second lower movable gap d5 which are used in accordance with the state of connection with the mating connector 20. The first lower movable gap d4 may not be provided. That is, the movable connector 10 may be configured such that the retention protrusions 12*a*3 are placed on the support surface portion 14*c*3 in the pre-fitting state.

The fixed housing fixed portion 14*d* is press-fitted into a displacement support member holding portion 11*a*6 formed in the bottom wall 11*a*4 of the fixed housing 11 (FIGS. 4 and 7). Consequently, the displacement support member 14 is fixed to the fixed housing 11. To press-fit the fixed housing fixed portion 14*d* into the displacement support member holding portion 11*a*6, the fixed housing fixed portion 14*d* is pushed into the displacement support member holding portion 11*a*6 with a press-fitting tool pushed against the lower edge portion of the base portion 14*b* which forms the hole portion 14*c*4. That is, the lower edge portion forms a press-fitting receiving portion 14*b*1.

Configuration of Mating Connector 20 [FIG. 7]

The mating connector 20 which serves as the "connection object" includes a mating housing 21 and a plurality of mating terminals 22. The mating connector 20 is mounted on a second substrate P2.

The mating housing 21 is formed as a resin molded body in a rectangular tubular shape, and includes a peripheral wall 21*a* and a bottom wall 21*b*. Fitting connection of the mating housing 21 with the movable housing 12 is established with the peripheral wall 21*a* inserted into the fitting chamber 12*a*1, in a rectangular frame shape, of the movable housing 12 and with fitting-side end portions 21*a*1 abutting against the bottom wall 12*b* of the movable housing 12 (see the fitting complete state in FIG. 8). The middle wall 12*c* of the movable housing 12 is inserted into a space inside the peripheral wall 21*a*. A plurality of terminal holding grooves 21*a*2 are formed in the inner surface of the peripheral wall 21*a* to be arranged in the right-left direction X. A mating contact portion 22*a* of the mating terminal 22 is disposed in each of the terminal holding grooves 21*a*2. The mating contact portion 22*a* of the mating terminal 22 has a two-contact point structure with a front contact portion 22*a*1 positioned on the front side in the fitting direction and a rear contact portion 22*a*2 positioned on the rear side in the fitting direction. The front contact portion 22*a*1 and the rear contact portion 22*a*2 are each formed as a bent terminal formed by bending a conductive metal piece, and each formed as a contact point spring bent in a mountain shape. Thus, such contact portions press-contact the contact portion 13*e* of the terminal 13 of the movable connector 10 with a predetermined contact pressure. Consequently, the terminal 13 and the mating terminal 22 make conductive contact with each other. Terminal holding portions (not illustrated) in a hole shape are formed in the bottom wall 21*b*. The mating terminals 22 are press-fitted into the terminal holding portions to be fixed.

Fitting Connection and Fitting Displacement between Movable Connector 10 and Mating Connector 20 [FIGS. 7 to 10]

First, fitting connection between the movable connector 10 and the mating connector 20 will be described.

As illustrated in FIG. 7, the movable connector 10 is mounted on the first substrate P1, the mating connector 20 is mounted on the second substrate P2, and the movable connector 10 and the mating connector 20 are located away from each other (pre-fitting state). From this pre-fitting state, the second substrate P2 is moved closer toward the first substrate P1 to insert the mating housing 21 of the mating connector 20 into the movable housing 12 of the movable housing 10. Upon receiving the force of inserting the mating connector 20, the movable housing 12 is displaced downward. At this time, the retention protrusions 12*a*3 are moved in the first lower movable gap d4 to abut against the support surface portion 14*c*3. The force of inserting the mating connector 20 is received with the retention protrusions 12*a*3 abutting against the support surface portion 14*c*3. Consequently, the mating housing 21 is inserted into the fitting chamber 12*a*1 of the movable housing 12, and the insertion of the mating connector 20 is stopped when the fitting-side end portions 21*a*1 abut against the bottom wall 12*b* which serves as a "connection object abutment portion". Consequently, fitting connection of the mating housing 21 with the fitting chamber 12*a*1 of the movable housing 12 is established (fitting complete state in FIG. 8).

In the course of establishing fitting connection described above, the movable housing 12 and the mating housing 21 occasionally positionally deviate from each other in at least one of the right-left direction X and the front-rear direction Y. However, when the mating housing 21 is inserted into the fitting chamber 12*a*1 of the movable housing 12, the movable portion 13*c* of the terminal 13 is elastically deformed so as to absorb the positional deviation. Consequently, the movable housing 12 can be displaced in the front-rear movable gap d1 and the right-left movable gap d2. Thus, fitting connection of the mating connector 20 with the movable connector 10 can be established with the positional deviation absorbed even if the housings deviate from the fitting position.

When the pre-fitting state illustrated in FIG. 7 and the fitting complete state illustrated in FIG. 8 are compared with each other, the retention protrusions 12*a*3 and the support surface portion 14*c*3 do not contact each other in the pre-fitting state, while the retention protrusions 12*a*3 and the support surface portion 14*c*3 contact each other in the fitting complete state. That is, in the fitting complete state, the movable housing 12 is slightly displaced toward the first substrate P1 with the movable portion 13*c* deflected. This state is obtained by fixing each of the first substrate P1 and the second substrate P2 to a support member, causing the weight of the second substrate P2 including the mating connector 20 to act on the movable portion 13*c*, etc. Thus, in the fitting complete state in FIG. 8, the movable portion 13*c* is slightly elastically deformed, and thus a repulsive force toward the mating connector 20 acts on the movable housing 12. The support member discussed earlier supports the first substrate P1 and the second substrate P2, and keeps the separation distance therebetween constant. Such a support member can be constituted of a spacer disposed between the first substrate P1 and the second substrate P2. The support member can also be constituted from a first split housing for electronic devices in which the first substrate P1 is disposed and a second split housing for electronic devices in which the second substrate P2 is disposed. In this case, the movable connector 10 and the mating connector 20 can be brought into the fitting complete state by combining the first split housing and the second split housing. The first split housing can be a body of a housing, for example, and the second split housing can be a lid that tightly closes the housing, for example.

Next, fitting displacement in the up-down direction Z between the movable connector 10 and the mating connector 20 will be described.

In the fitting complete state illustrated in FIG. 8, either of the first substrate P1 and the second substrate P2 is occasionally deflected in the up-down direction Z (fitting direction or extraction direction) because of vibration or an impact caused under the use environment of the movable connector 10. Here, by way of example, fitting displacement caused in a state in which the first substrate P1 is deflected so as to project toward the second substrate P2 so that the movable connector 10 is biased toward the second substrate P2 while the second substrate P2 is not deflected and the mating connector 20 is not moved will be described.

When the first substrate P1 is deflected so as to project toward the second substrate P2, the movable connector 10 is urged to be displaced toward the second substrate P2. At this time, the fixed housing 11 is displaced toward the second substrate P2, but fitting connection of the movable housing 12 with the mating connector 20 in the stationary state has been established. Therefore, the movable housing 12 is not displaced toward the second substrate P2, and the first substrate P1 is displaced closer toward the movable housing 12. This, in other words, corresponds to only the second substrate P2 being deflected so as to project toward the first substrate P1 and the mating connector 20 being displaced in the fitting direction (downward in the up-down direction Z) closer toward the first substrate P1.

Figure 9:
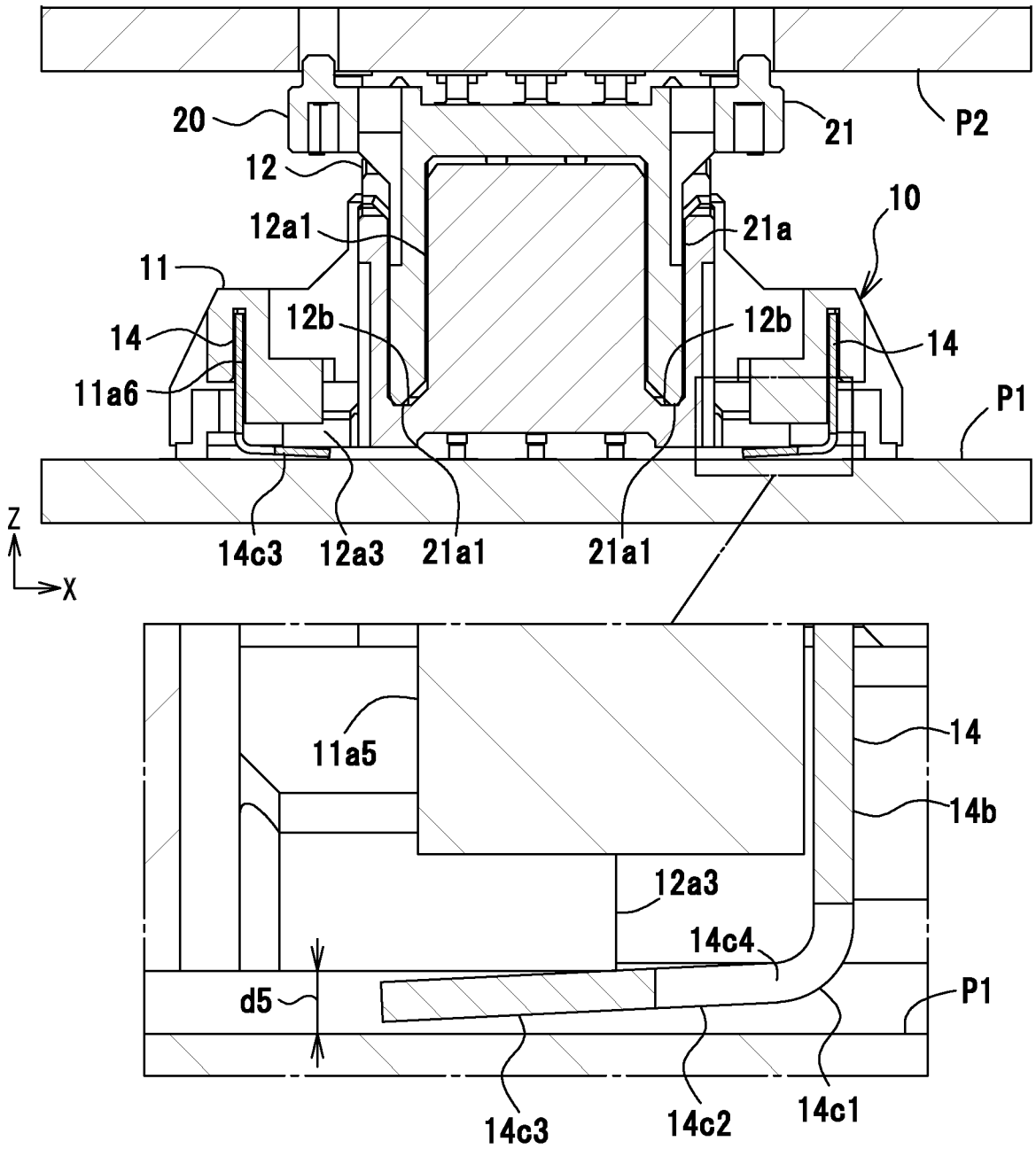
FIG. 9 is a sectional view illustrating a fitting displacement state in which the movable housing has been relatively displaced downward in the Z direction from the fitting complete state in FIG. 8.

Then, the movable housing 12 is relatively displaced closer toward the first substrate P1 with the movable portion 13*c* elastically deformed. At this time, the retention protrusions 12*a*3 of the movable housing 12 push down the support surface portion 14*c*3 of the flexible support portion 14*c* toward the first substrate P1 to be deflected as illustrated in FIG. 9. The support surface portion 14*c*3 is displaced toward the second lower movable gap d5 to approach the first substrate P1 with the spring piece portions 14*c*2 elastically deformed with the bent portions 14*c*1 serving as the displacement support point. Consequently, the movable housing 12 is also relatively displaced toward the second lower movable gap d5 closer toward the first substrate P1. In this manner, the movable housing 12 can be relatively displaced downward (fitting direction) in the up-down direction Z.

In a state in which the movable housing 12 is relatively displaced downward in the up-down direction Z, the retention protrusions 12*a*3 of the movable housing 12 contact the support surface portion 14*c*3 of the flexible support portion 14*c*, and the fitting-side end portions 21*a*1 of the mating housing 21 contact the bottom wall 12*b* of the movable housing 12. Therefore, the position of fitting between the movable housing 12 and the mating housing 21 is not varied, and the position of contact of the mating contact portion 22*a* of the mating terminal 22 with the contact portion 13*e* of the terminal 13 is maintained. Thus, contact point slide between the contact portion 13*e* and the mating contact portion 22*a* is not caused.

When the first substrate P1 is returned to the original non-deflected state, the fixed housing 11 is returned to the position in the fitting complete state. At this time, the movable housing 12 is relatively displaced upward (extraction direction) in the up-down direction Z with respect to the fixed housing 11 and the first substrate P1. Then, the support surface portion 14*c*3 which has been deflected is returned to the original state, and can be returned to the position in the fitting complete state. In this manner, the movable housing 12 can be relatively displaced upward (extraction direction) in the up-down direction Z.

Also when the movable housing 12 is relatively displaced upward in the up-down direction Z, the position of fitting between the movable housing 12 and the mating housing 21 is not varied. That is, an extraction force that is necessary to extract the mating housing 21 from the movable housing 12 is larger than a force that is necessary to displace the movable housing 12 upward in the up-down direction Z by elastically deforming the movable portion 13*c*. Thus, the position of contact of the mating contact portion 22*a* of the mating terminal 22 with the contact portion 13*e* of the terminal 13 is maintained also when the movable housing 12 is relatively displaced upward in the up-down direction Z, and contact point slide between the contact portion 13*e* and the mating contact portion 22*a* is not caused.

Operation of the movable connector 10 described above has been described using an example in which only the first substrate P1 is deflected so as to project toward the second substrate P2 in the stationary state and thereafter the first substrate P1 is returned to the original state. However, operation of the movable connector 10 is also the same for a case where only the second substrate P2 is deflected so as to project toward the first substrate P1 in the stationary state and thereafter the second substrate P2 is returned to the original state and a case where both the first substrate P1 and the second substrate P2 are deflected so as to project toward each other and thereafter the first substrate P1 and the second substrate P2 are returned to the original state. It should be noted, however, that initial motion of the movable connector 10 is different as described next in the case where at least one of the first substrate P1 and the second substrate P2 is deflected so as to project in the direction away from each other and thereafter the substrate is returned to the original state.

In the fitting complete state illustrated in FIG. 8, the retention protrusions 12*a*3 of the movable housing 12 contact the support surface portion 14*c*3 of the displacement support member 14. When at least one of the first substrate P1 and the second substrate P2 is deflected from this state so as to project in the direction relatively away from each other, the movable housing 12 is relatively displaced in the direction away from the first substrate P1 through elastic deformation of the movable portion 13*c*.

Figure 10:
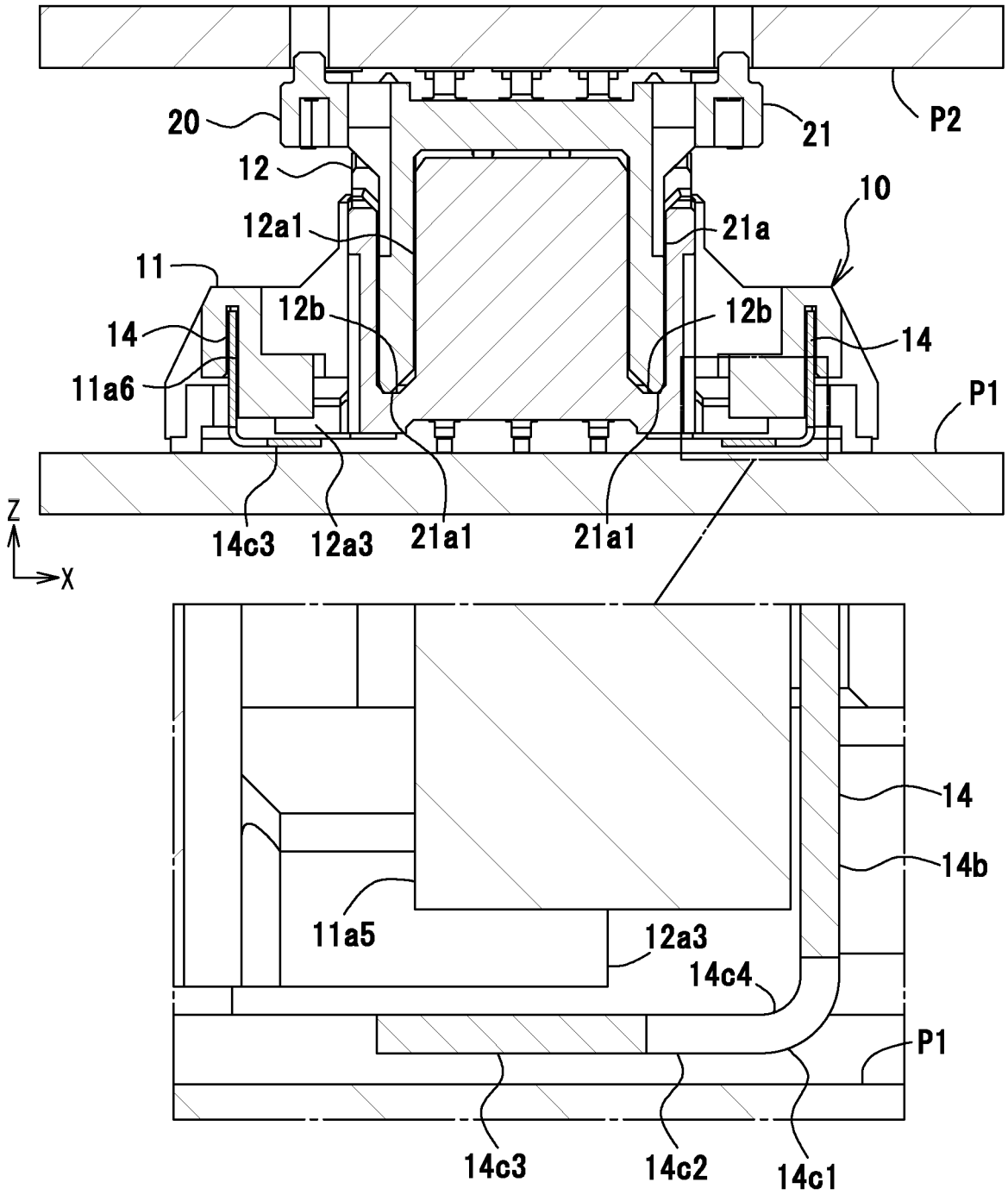
FIG. 10 is a sectional view illustrating a fitting displacement state in which the movable housing has been relatively displaced upward in the Z direction from the state in FIG. 8 or 9.
Figure 11:
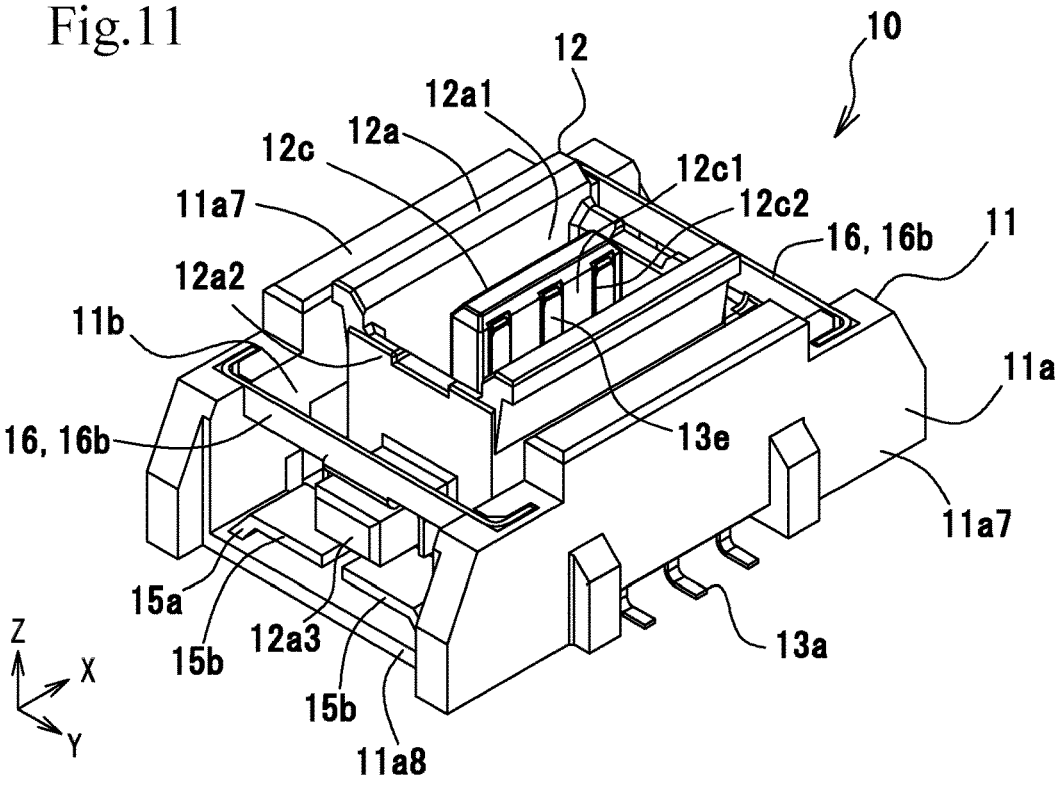
FIG. 11 is a perspective view including a front surface, a left side surface, and an upper surface of a movable connector according to a second embodiment.

At this time, as illustrated in FIG. 10, the retention protrusions 12*a*3 are occasionally moved away from the support surface portion 14*c*3, and the state in which the position of fitting between the movable housing 12 and the mating housing 21 is maintained is occasionally canceled. Then, the position of contact between the contact portion 13*e* and the mating contact portion 22*a* cannot be maintained, and contact point slide may be caused. In the present embodiment, however, an extraction force that is necessary to extract the mating connector 20 from the movable connector 10 is set to be high. In this embodiment, this extraction force is composed of a contact pressure between the contact portion 13*e* and the mating contact portion 22*a* in the fitting complete state and a friction force (interterminal friction force) between the contact portion 13*e* and the mating contact portion 22*a*. Thus, the movable portion 13*c* can be elastically deformed with the position of contact between the contact portion 13*e* and the mating contact portion 22*a* maintained. In other words, in the connection structure for the movable connector 10 according to the present embodiment, the extraction force between the terminals is set to be larger than the displacement load for the movable portion 13*c*. Therefore, even if the retention protrusions 12*a*3 are moved away from the support surface portion 14*c*3, the position of contact between the contact portion 13*e* and the mating contact portion 22*a* is maintained since the extraction force is set to be high, and contact point slide between the contact portion 13*e* and the mating contact portion 22*a* is not caused. That is, the position of fitting between the movable housing 12 and the mating housing 21 is not varied.

The contact pressure between the contact portion 13*e* and the mating contact portion 22*a* is determined in accordance with the arrangement of the contact portion 13*e* in the movable connector 10, which affects the distance between the contact portion 13*e* and the mating contact portion 22*a*, the plate thickness of the contact portion 13*e*, the spring constant of the mating contact portion 22*a*, etc. Thus, the contact pressure is not determined in accordance with a structural element that includes only the mating contact portion 22 with a spring structure, but the contact portion 13*e* of the terminal 13 is also a structural element that affects the contact pressure and, further, the extraction force including the contact pressure.

As has been described above, the movable connector 10 according to the present embodiment can effectively suppress occurrence of contact point slide. Examples of the method of suppressing occurrence of contact point slide include setting the spring of the movable portion 13*c* to be stiff in order that the movable portion 13*c* biases the movable housing 12 against the mating connector 20 at all times. With that method, however, the spring of the movable portion 13*c* is so stiff that it is difficult to design the movable connector 10 which exhibits a floating function that makes use of flexible deformation of the movable portion 13*c*. With the movable connector 10 according to the present embodiment, in contrast, the spring of the movable portion 13*c* can be set to be soft, and thus a floating function that makes use of flexible deformation of the movable portion 13*c* can be achieved.

Second Embodiment [FIGS. 11 to 18]

Configuration of Movable Connector 10 [FIGS. 11 to 15]

The movable connector 10 according to a second embodiment differs from the first embodiment, in which the displacement support member 14 is separate from the fixed housing 11, in that a flexible support portion 15 is formed integrally with the fixed housing 11. In addition, the movable connector 10 according to the second embodiment differs from the first embodiment, in which displacement regulation is performed by the fixed housing 11, in that a displacement regulation member 16 regulates displacement of the retention protrusions 12*a*3. The other components of the second embodiment and the functions and effects based thereon are similar to those according to the first embodiment, and therefore will not be described unless such components, functions, and effects are to be particularly referred to. The features of the second embodiment will be mainly described below.

The fixed housing 11 is formed with a pair of side walls 11*a*7 in a vertical wall shape that extend in the right-left direction X and that project upward in the up-down direction Z and right and left bottom walls 11*a*8 in a flat plate shape that connect between both ends of the pair of side walls 11*a*7. In this manner, the fixed housing 11 has a housing structure in which there are no walls that form a closed space or a space surrounded by a peripheral wall above the pair of side walls 11*a*7 and the right and left bottom walls 11*a*8. In addition, an opening portion 11*a*9 is formed between the right and left bottom walls 11*a*8. The movable housing 12 is positioned above the opening portion 11*a*9 (FIG. 13), and the lower end portion of the movable housing 12 is inserted into the opening portion 11*a*9. Thus, the height of the movable housing 12 is reduced, and the overall size of movable connector 10 is reduced.

The right and left bottom walls 11*a*8 are each formed with the flexible support portion 15. The flexible support portion 15 according to the present embodiment is a resin molded body formed integrally with the fixed housing 11. However, the flexible support portion 15 may be constituted as a metal piece insert-molded in the fixed housing 11. The flexible support portion 15 is formed as a spring piece in a cantilever shape. More specifically, the flexible support portion 15 includes a spring piece portion 15*a* that extends obliquely upward in the up-down direction Z from the bottom wall 11*a*8 of the fixed housing 11 and a support surface portion 15*b* that extends in the horizontal direction from the spring piece portion 15*a*. The spring piece portion 15*a* is deflectable upward and downward in the up-down direction Z, and thus the support surface portion 15*b* is displaceable in the up-down direction Z.

Figure 12:
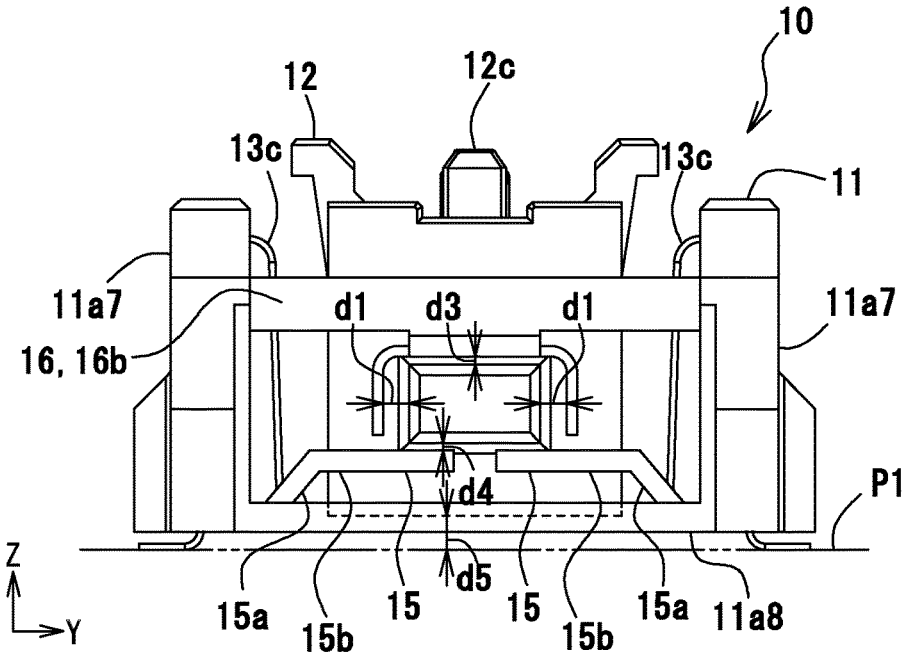
FIG. 12 is a left side view of the movable connector in FIG. 11.

A first lower movable gap d4 is formed between the support surface portion 15*b* and the retention protrusions 12*a*3 of the movable housing 12 which face each other (FIG. 12). The first lower movable gap d4 enables the movable housing 12 in the pre-fitting state to be displaced downward (fitting direction) in the up-down direction Z.

A second lower movable gap d5 is formed between the first substrate P1 and the bottom surface (lower end surfaces of the side walls 11*a*7 and the bottom walls 11*a*8) of the movable housing 12 (FIG. 12). The second lower movable gap d5 enables the movable housing 12 to be displaced downward (fitting direction) in the up-down direction Z with the support surface portion 15*b* deflected using the spring piece portion 15*a* as the displacement support point.

The movable housing 12 is displaceable toward the second lower movable gap d5, and can be actually displaced over a distance to the limit position of deflection of the support surface portion 15*b* toward the bottom wall 11*a*8, the distance becoming longest when the support surface portion 15*b* abuts against the bottom wall 11*a*8. In this manner, the movable connector 10 according to the second embodiment is also structured to have the first lower movable gap d4 and the second lower movable gap d5.

Figure 15:
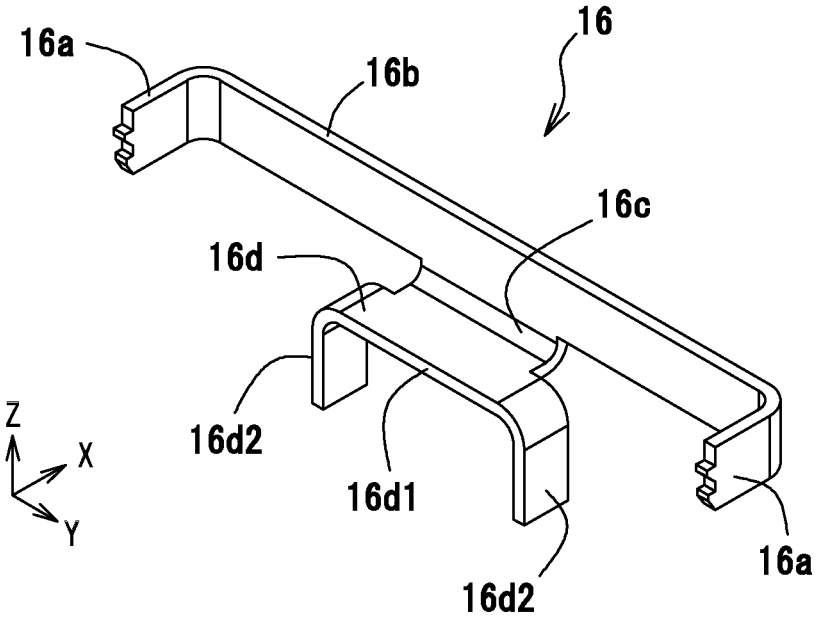
FIG. 15 is a perspective view of a displacement regulation member of the movable connector in FIG. 11.

As illustrated in FIG. 15, the displacement regulation member 16 is formed as a metal fitting by stamping a metal piece in a flat plate shape as the material by pressing and bending the metal piece in the plate thickness direction at predetermined locations. The displacement regulation member 16 includes a pair of fixed housing fixed portions 16*a*, a base portion 16*b*, a bent portion 16*c*, and a displacement regulation portion 16*d*.

The fixed housing fixed portions 16*a* are press-fitted into displacement regulation member holding portions 11*a*10, which are provided in the pair of side walls 11*a*7 of the fixed housing 11, to be fixed. The base portion 16*b* extends between the pair of fixed housing fixed portions 16*a* so as to cross between the pair of side walls 11*a*7. The bent portion 16*c* is bent from the lower edge of the base portion 16*b* to support the displacement regulation portion 16*d*.

The displacement regulation portion 16*d* is supported by the bent portion 16*c*, and has a function of regulating displacement of the movable housing 12 with the retention protrusions 12*a*3 of the movable housing 12 abutting against the displacement regulation portion 16*d*. More specifically, the displacement regulation portion 16*d* includes a transverse piece portion 16*d*1 which serves as a "first displacement regulation portion" that extends along the front-rear direction Y and a pair of side piece portions 16*d*2 which serve as a "second displacement regulation portion" that extends vertically downward from both ends of the transverse piece portion 16*d*1.

Figure 13:
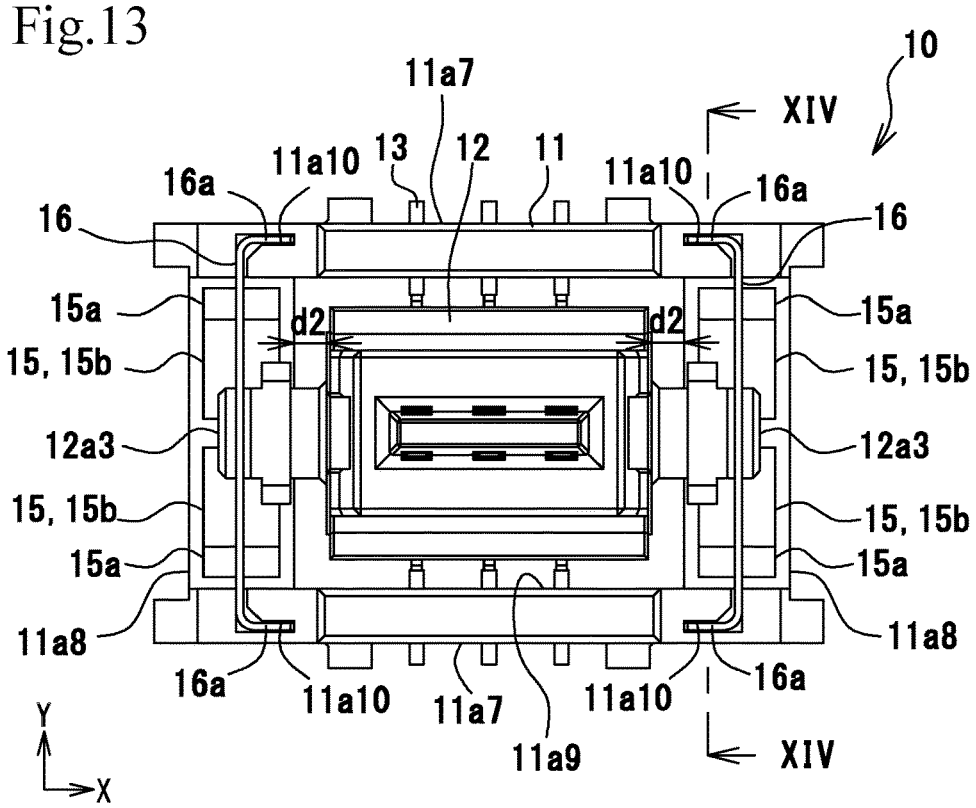
FIG. 13 is a plan view of the movable connector in FIG. 11.
Figure 14:
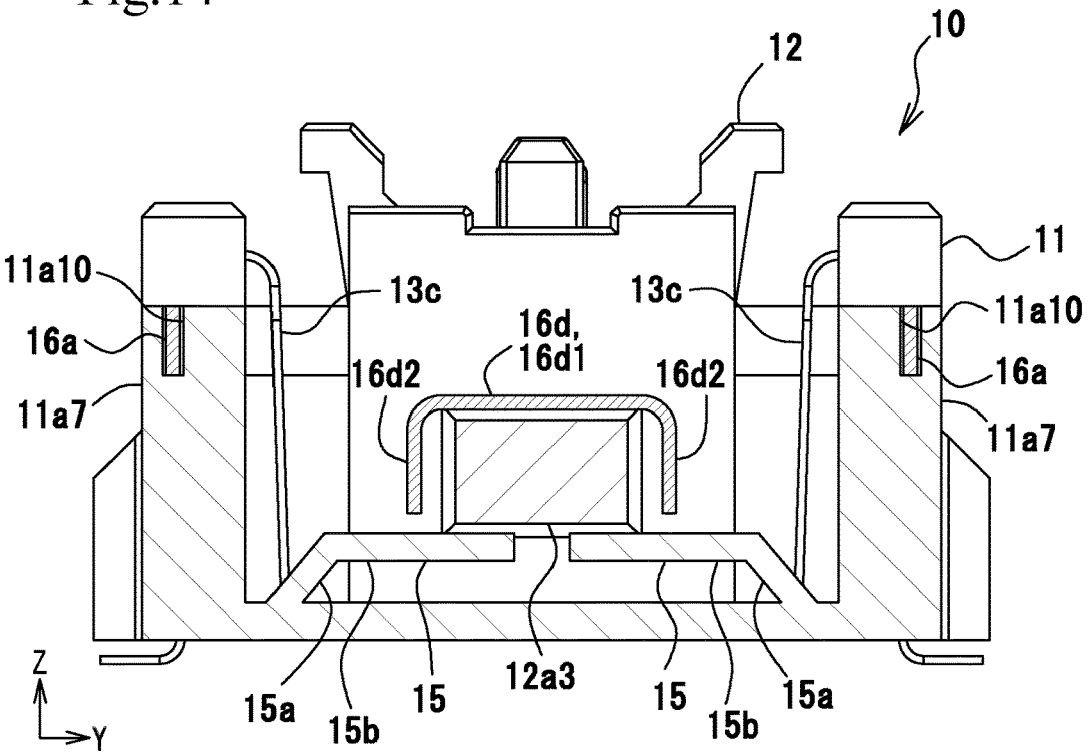
FIG. 14 is a sectional view taken along the line XIV-XIV in FIG. 13.

An upper movable gap d3 is formed between the transverse piece portion 16*d*1 and the retention protrusions 12*a*3 (FIG. 12). The upper movable gap d3 enables the movable housing 12 in the stationary state (pre-fitting state (FIGS. 12 and 14) and fitting complete state (FIG. 16)) to be displaced upward in the up-down direction Z. In addition, a front-rear movable gap dl is formed between the pair of side piece portions 16*d*2 and the retention protrusions 12*a*3 (FIG. 12). The front-rear movable gap dl enables the movable housing 12 in the stationary state to be displaced in the front-rear direction Y. Further, a right-left movable gap d2 is formed between the transverse piece portion 16*d*1 and the side piece portions 16*d*2 and the side walls 12*a*2 of the movable housing 12 (FIG. 13). The right-left movable gap d2 enables the movable housing 12 in the stationary state to be displaced in the right-left direction X.

As described above, the displacement regulation portion 16*d* of the displacement regulation member 16 can function to regulate excessive displacement of the movable housing 12 in the right-left direction X (direction which crosses the fitting direction), the front-rear direction Y (direction which crosses the fitting direction), and upward (extraction direction) in the up-down direction Z. In addition, the displacement regulation member 16 is formed separately from the fixed housing 11, and thus the fixed housing 11 can be structured simply, and manufactured and assembled easily. Further, the displacement regulation member 16 includes both the transverse piece portion 16*d*1 and the side piece portions 16*d*2, and thus the number of parts can be reduced and the connector structure can be simplified compared to a case where such portions are constituted from separate members. Consequently, the size of the movable connector 10 can be reduced.

Figure 16:
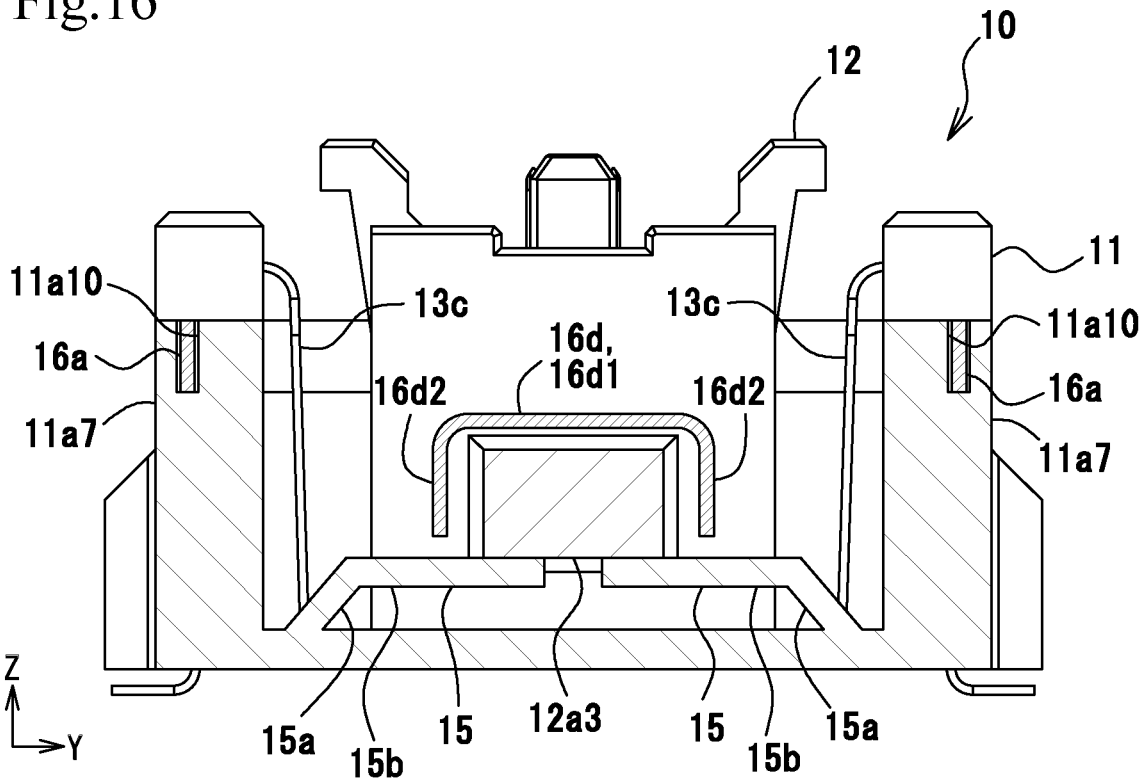
FIG. 16 is a sectional view corresponding to FIG. 14, illustrating a fitting complete state in which the movable connector in FIG. 11 is completely fitted with a mating connector.
Figure 17:
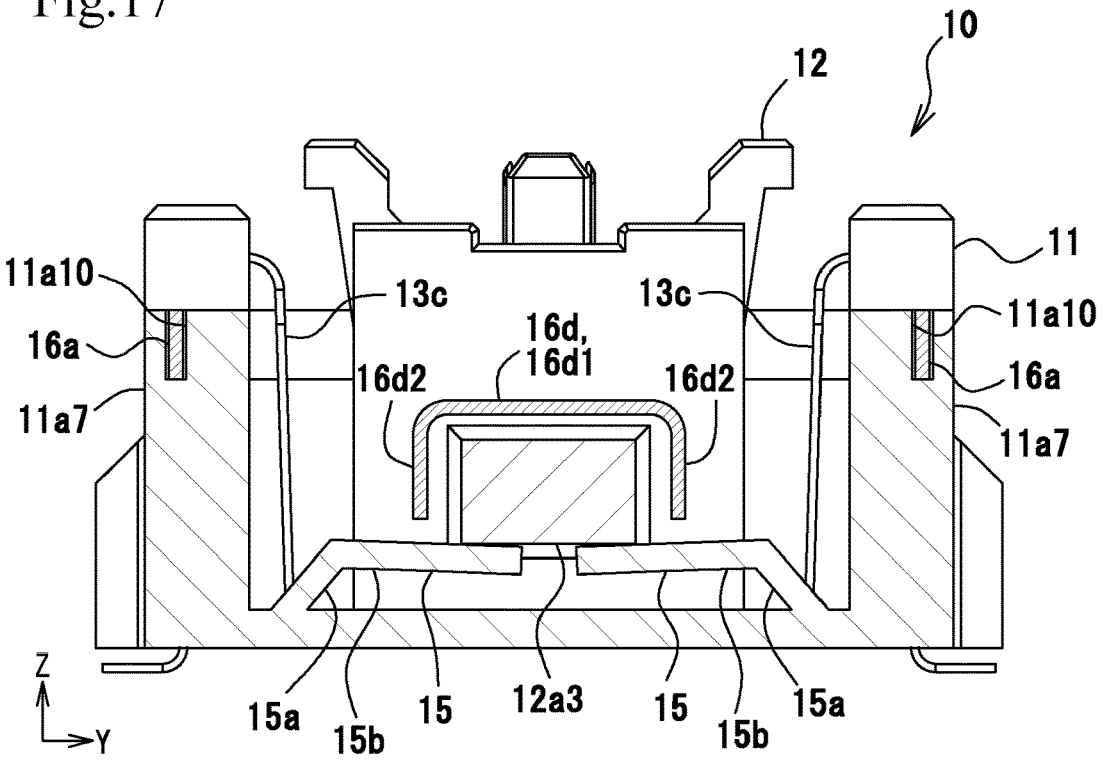
FIG. 17 is a sectional view corresponding to FIG. 14, illustrating a fitting displacement state in which the movable housing has been relatively displaced downward in the Z direction from the state in FIG. 16.
Figure 18:
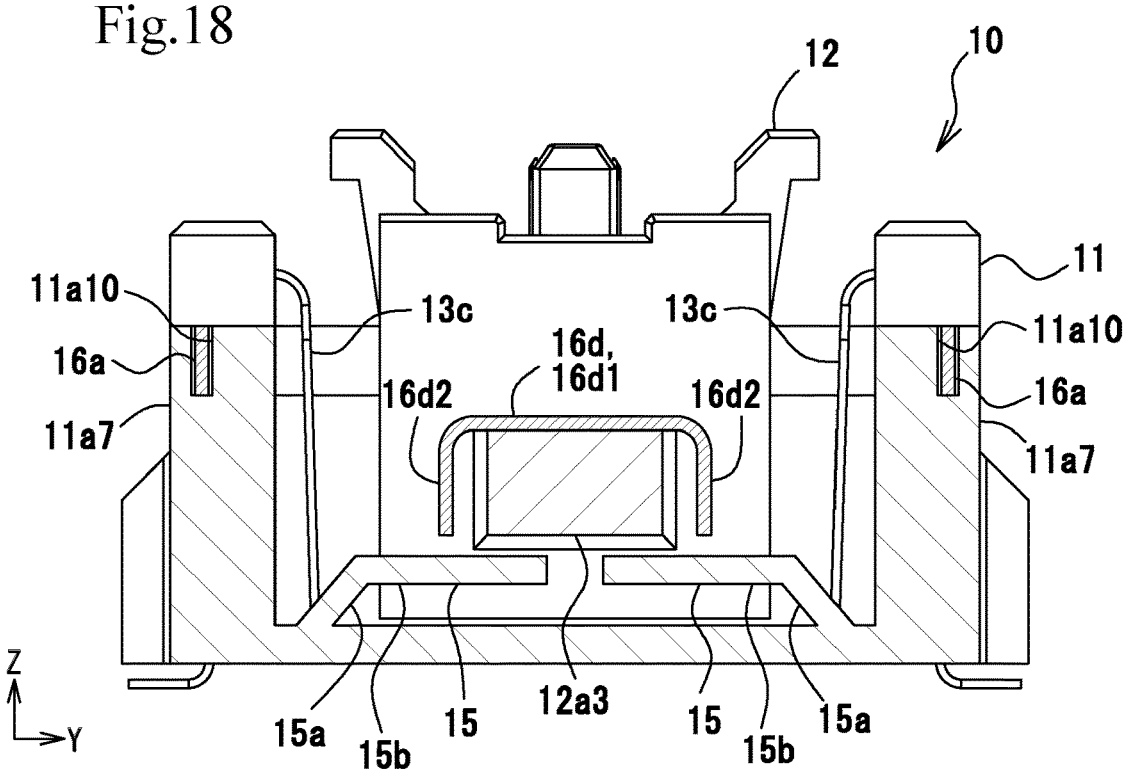
FIG. 18 is a sectional view corresponding to FIG. 14, illustrating a fitting displacement state in which the movable housing has been relatively displaced upward in the Z direction from the state in FIG. 16 or 17.

Fitting Connection and Fitting Displacement between Movable Connector 10 and Mating Connector 20 [FIGS. 16 to 18]

Fitting connection between the movable connector 10 and the mating connector 20 is the same as that for the movable connector 10 according to the first embodiment. That is, the mating housing 21 may be inserted into the movable housing 12 by moving the movable connector 10 and the mating connector 20 in the pre-fitting state closer toward each other. Upon receiving the force of inserting the mating connector 20, the movable housing 12 is displaced downward. At this time, the retention protrusions 12*a*3 are moved in the first lower movable gap d4 to abut against the support surface portion 15*b* (position of the movable housing 12 in FIG. 16). The force of inserting the mating connector 20 is received with the retention protrusions 12*a*3 abutting against the support surface portion 15*b*. Consequently, the mating housing 21 is inserted into the fitting chamber 12*a*1 of the movable housing 12, and the insertion of the mating connector 20 is stopped when the fitting-side end portions 21*a*1 abut against the bottom wall 12*b* which serves as a "connection object abutment portion". Consequently, fitting connection of the mating housing 21 with the fitting chamber 12*a*1 of the movable housing 12 is established (see the fitting complete state in FIG. 8).

Next, fitting displacement in the up-down direction Z between the movable connector 10 and the mating connector 20, which is the same as fitting displacement of the movable connector 10 according to the first embodiment, will be described. That is, when the movable housing 12 is relatively displaced downward in the up-down direction Z with the movable portion 13*c* elastically deformed, the retention protrusions 12*a*3 push down the support surface portions 15*b* toward the first substrate P1 to be deflected as illustrated in FIG. 17. The support surface portions 15*b* are displaced to approach the first substrate P1 with the spring piece portions 15*a* elastically deformed. Consequently, the movable housing 12 is also relatively displaced toward the second lower movable gap d5 closer toward the first substrate P1. In this manner, the movable housing 12 can be relatively displaced downward (fitting direction) in the up-down direction Z. In this manner, contact point slide is not caused, as in the first embodiment, in the case where the movable housing 12 is displaced in the fitting direction.

In addition, when the movable housing 12 is relatively displaced in the direction away from the first substrate P1 through elastic deformation of the movable portion 13*c*, the retention protrusions 12*a*3 are occasionally moved away from the support surface portion 15*b*, and the state in which the position of fitting between the movable housing 12 and the mating housing 21 is maintained is occasionally canceled, as illustrated in FIG. 18. Then, the position of contact between the contact portion 13*e* and the mating contact portion 22*a* cannot be maintained, and contact point slide may be caused. Also with the movable connector 10 according to the present embodiment, however, the extraction force in the fitting complete state is set to be large, and the movable portion 13*c* can be elastically deformed with the position of contact between the contact portion 13*e* and the mating contact portion 22*a* maintained. Thus, even if the retention protrusions 12*a*3 are moved away from the support surface portion 15*b*, the position of contact between the contact portion 13*e* and the mating contact portion 22*a* is maintained since the extraction force is set to be high, and contact point slide between the contact portion 13*e* and the mating contact portion 22*a* is not caused. That is, the position of fitting between the movable housing 12 and the mating housing 21 is not varied, as in the first embodiment.

Modifications

The above embodiments can be implemented with the components partially modified. Several examples will be described.

Figure 19:
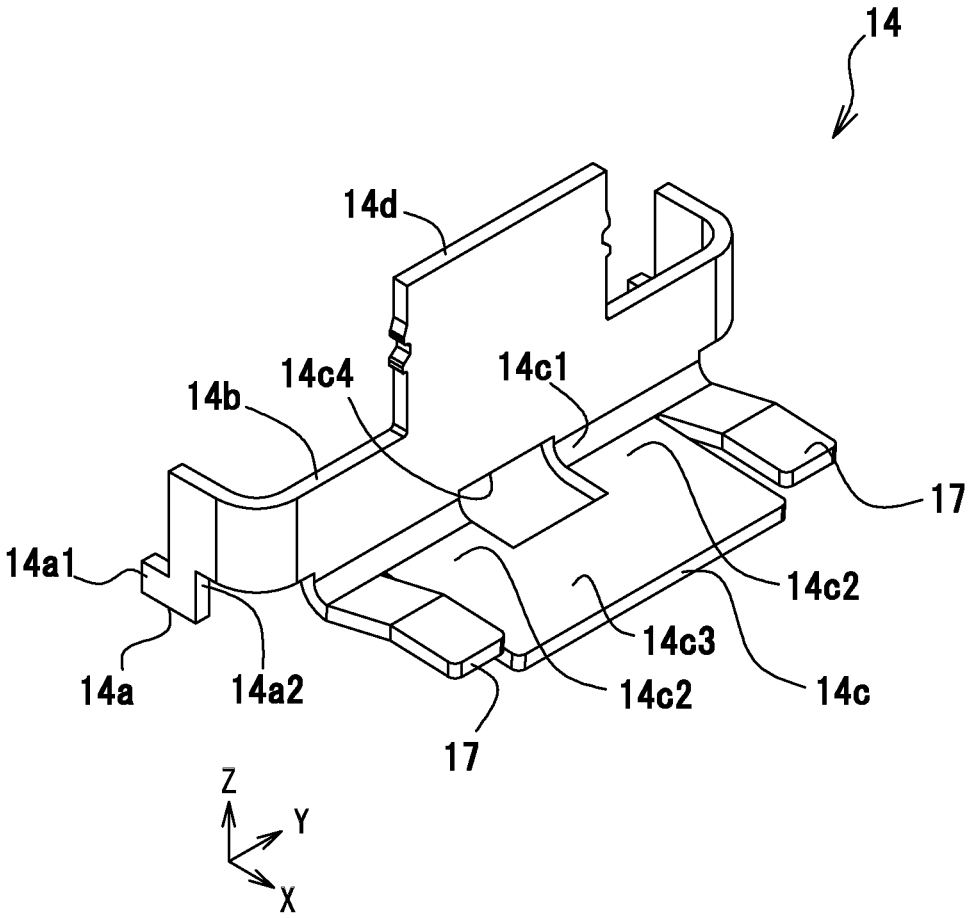
FIG. 19 is a perspective view illustrating a modification of the displacement support member of the movable connector according to the first embodiment.

In the first embodiment, the flexible support portion 14*c* is configured such that the support surface portion 14*c*3 is provided at the distal ends of the pair of spring piece portions 14*c*2. However, auxiliary flexible support portions 17 which serve as an "extraction direction bias spring" formed of a spring piece that extends upward in the up-down direction Z with respect to the support surface portion 14*c*3 in the free state may be provided in addition to the support surface portion 14*c*3, for example. An example of such a modification is illustrated in FIG. 19.

In the first embodiment, as illustrated in FIG. 10, when excessive deflection is caused in the direction in which the first substrate P1 and the second substrate P2 are moved away from each other, the retention protrusions 12*a*3 may be moved away from the support surface portion 14*c*3 with the movable housing 12 relatively displaced. Then, the movable housing 12 and the mating housing 21 may be relatively moved away in the extraction direction. In order to prevent that, in the first embodiment and the second embodiment, the extraction force which is necessary to extract the mating connector 20 from the movable connector 10 is set to be larger than the displacement load for the movable portion 13*c*, and the movable portion 13*c* can be elastically deformed with the position of contact between the contact portion 13*e* and the mating contact portion 22*a* maintained.

By providing the auxiliary flexible support portions 17 which are each formed of a spring piece as in the modification, in contrast, the movable housing 12 can be biased toward the mating housing 21 by the auxiliary flexible support portions 17 even if the retention protrusions 12*a*3 are moved away from the support surface portion 14*c*3. Thus, the movable housing 12 can be caused to follow displacement of the mating housing 21 with the fitting complete state maintained, which can suppress occurrence of contact point slide. In this case, the contact pressure between the terminals can be set to be low compared to the movable connectors 10 according to the first embodiment and the second embodiment, and thus advantageously the insertion force during connection work can be further reduced.

From the viewpoint of preventing positional deviation of the fitting position in the fitting direction and the extraction direction between the movable housing 12 and the mating housing 21, the second housing 12 and the mating housing 21 may be provided with a press-fitting portion so that a friction force (interhousing friction force) for positional deviation prevention may be generated in the fitting complete state, for example. This friction force composes an "extraction force" for suppressing occurrence of contact point slide when the movable housing 12 is displaced in the extraction direction, together with the contact pressure between the contact portion 13*e* and the mating contact portion 22*a* and the friction force (interterminal friction force) between the contact portion 13*e* and the mating contact portion 22*a*. Alternatively, the movable housing 12 and the mating housing 21 may be provided with a fitting lock portion formed from an engagement protrusion and an engagement recessed portion that lock each other in the fitting complete state to prevent positional deviation.

In the embodiments described above, the mating terminal 22 is provided with the mating contact portion 22*a* with a spring structure, and the terminal 13 of the movable connector 10 includes the contact portion 13*e* in a flat plate shape. However, the terminal 13 may be provided with a contact portion with a spring structure, and the mating terminal 22 may be provided with a contact portion without a spring structure.

In the embodiments described above, an electric connector (mating connector 20) is provided as an example of the "connection object". However, the "connection object" is not limited to an electric connector, and may be a flat conductor such as an FPC and an FFC, a bus bar, a terminal such as a connection pin, an electronic part including an electric element, etc. In this case, the configuration of the movable connector 10 can be varied in accordance with the "connection object".

In the embodiments described above, the bottom wall 12*b* of the movable housing 12 is the "connection object abutment portion", against which the fitting-side end portions 21*a*1 of the peripheral wall 21*a* of the mating housing 21 abut. However, the structure for achieving such interhousing contact is not limited to interhousing contact made inside the fitting chamber 12*a*1. In short, it is only necessary that there should be a portion in which the movable housing 12 and the mating housing 21 contact each other, and it is only necessary that the contact portion should be located outside the fitting chamber 12*a*1. For example, the opening-side end portion of the peripheral wall 12*a* of the movable housing 12 may contact the mating connector 20 or the second substrate P2.

What is claimed is:

1. A movable connector comprising:

a first housing to be fixed to a first substrate;

a second housing to be fitted with a connection object; and a terminal that includes a movable portion that supports the first housing and the second housing so as to be relatively displaceable and a contact portion that makes conductive contact with the connection object, wherein the movable connector further includes a displacement support member that includes a flexible support portion that is elastically deformable in a fitting direction, in which the connection object is to be fitted with the second housing, with the flexible support portion abutting against the second housing, the second housing includes a connection object abutment portion, against which the connection object abuts in the fitting direction, and the second housing is displaced in the fitting direction with the flexible support portion elastically deformed in the fitting direction when the connection object presses the connection object abutment portion in the fitting direction.

2. The movable connector according to claim 1, wherein the displacement support member includes a first housing fixed portion fixed to the first housing, and a first substrate fixed portion to be fixed to the first substrate.

3. The movable connector according to claim 1, wherein the displacement support member includes an auxiliary flexible support portion formed of a spring that biases the second housing in an extraction direction for extraction of the connection object, which is opposite to the fitting direction, to maintain the connection object abutment portion and the connection object in abutment with each other.

4. A movable connector comprising:

a first housing to be fixed to a first substrate;

a second housing to be fitted with a connection object; and a terminal that includes a movable portion that supports the first housing and the second housing so as to be relatively displaceable and a contact portion that makes conductive contact with the connection object, wherein the first housing includes a flexible support portion that is elastically deformable in a fitting direction, in which the connection object is to be fitted with the second housing, with the flexible support portion abutting against the second housing, the second housing includes a connection object abutment portion, against which the connection object abuts in the fitting direction, and the second housing is displaced in the fitting direction with the flexible support portion elastically deformed in the fitting direction when the connection object presses the connection object abutment portion in the fitting direction.

5. The movable connector according to claim 4, wherein the first housing includes a pair of first side walls, and the movable connector further includes a displacement regulation member provided on the first housing so as to cross between the first side walls, the displacement regulation member including a first displacement regulation portion that regulates displacement of the second housing in an extraction direction which is opposite to the fitting direction.

6. The movable connector according to claim 5, wherein the displacement regulation member includes a second displacement regulation portion that regulates displacement of the second housing in a direction that intersects the fitting direction.

7. The movable connector according to claim 5, wherein the first housing is formed from a bottom wall disposed on the first substrate and the pair of side walls which are formed as vertical walls that extend upward from the bottom wall, and the displacement regulation member is provided on the first housing so as to cross above the second housing which is disposed inside the first housing.

* * * * *